US010875747B2

(12) United States Patent
Borøy et al.

(10) Patent No.: US 10,875,747 B2
(45) Date of Patent: Dec. 29, 2020

(54) WIRE BACK TENSION DEVICE

(71) Applicant: National Oilwell Varco Norway AS, Kristiansand S (NO)

(72) Inventors: Yngvar Borøy, Kristiansand S (NO); Adrian Mihai Orasanu, Braila (RO); Thor Strand, Kristiansand (NO)

(73) Assignee: National Oilwell Varco Norway AS

( * ) Notice: Subject to any disclaimer, the term of this patent is extended or adjusted under 35 U.S.C. 154(b) by 102 days.

(21) Appl. No.: 16/065,011

(22) PCT Filed: Jan. 4, 2017

(86) PCT No.: PCT/NO2017/050001
§ 371 (c)(1),
(2) Date: Jun. 21, 2018

(87) PCT Pub. No.: WO2017/119818
PCT Pub. Date: Jul. 13, 2017

(65) Prior Publication Data

US 2019/0002249 A1 Jan. 3, 2019

(30) Foreign Application Priority Data

Jan. 7, 2016 (NO) ..... 20160031

(51) Int. Cl.
*B66C 13/02* (2006.01)
*B66D 3/00* (2006.01)

(52) U.S. Cl.
CPC ..... *B66C 13/02* (2013.01); *B66D 3/003* (2013.01)

(58) Field of Classification Search
CPC ..... B66C 13/02; B66C 13/10; B66D 3/003; B66D 3/06; B66D 3/08; B66D 1/50; E21B 19/22; E21B 19/08
See application file for complete search history.

(56) References Cited

U.S. PATENT DOCUMENTS 2,647,699 A 8/1953 Bush
3,843,096 A * 10/1974 Wilson ..... B66D 1/50 254/270

(Continued)

FOREIGN PATENT DOCUMENTS

EP 2878569 A1 6/2015
GB 146149 A 6/1921

(Continued)

OTHER PUBLICATIONS

English translation of abstract to JP H10139362 (1 page).

(Continued)

*Primary Examiner* — William A. Rivera
(74) *Attorney, Agent, or Firm* — Conley Rose, P.C.

(57) ABSTRACT

A device for tensioning an elongated hoisting member, comprises: a first friction-generating member rotatably supported around a first support member; a second friction-generating member rotatably supported around a second support member, the first and second friction-generating members being adapted to provide friction to the elongated hoisting member when the friction-generating members are pressed against each other with a portion of the elongated hoisting member therebetween. A brake is provided for braking the rotation of the friction-generating members around the support members. There is also described a system that includes such a device, as well as a method for operating such a system.

19 Claims, 4 Drawing Sheets

(56) References Cited

U.S. PATENT DOCUMENTS

| | | | | |
|---|---|---|---|---|
| 3,881,647 | A * | 5/1975 | Wolfe | B65H 51/14 226/172 |
| 4,508,251 | A | 4/1985 | Harada et al. | |
| 5,009,353 | A | 4/1991 | Alquist | |
| 5,775,417 | A | 7/1998 | Council | |
| 6,328,502 | B1 * | 12/2001 | Hickey | B63B 35/03 405/168.3 |
| 2010/0127229 | A1 * | 5/2010 | Kverneland | E21B 19/008 254/356 |
| 2013/0161441 | A1 | 6/2013 | Bjoernenak | |
| 2014/0060807 | A1 | 3/2014 | Bjoernenak | |
| 2016/0083228 | A1 * | 3/2016 | Holck | B63B 35/4413 414/138.2 |
| 2016/0333651 | A1 * | 11/2016 | Bjornenak | E21B 19/22 |

FOREIGN PATENT DOCUMENTS

| | | |
|---|---|---|
| GB | 2457585 | 8/2009 |
| JP | H10139362 | 5/1998 |
| WO | 2014163508 | 10/2014 |

OTHER PUBLICATIONS

Search Report for Norwegian Application No. 20160031 dated Jul. 18, 2016 (2 pages).
Search Report without ISR for PCT/NO 2017/050001 (16 pages).
International Search Report and Written Opinion dated Aug. 24, 2018 for International Application No. PCT/NO2017/050001.

* cited by examiner

WIRE BACK TENSION DEVICE

CROSS REFERENCE TO RELATED APPLICATIONS

This application is a 35 U.S.C. § 371 national stage application of PCT/NO2017/050001 filed Jan. 4, 2017 and entitled "Wire Back Tension Device", which claims priority to Norwegian Patent Application No. 20160031 filed Jan. 7, 2016, each of which is incorporated herein by reference in their entirety for all purposes.

STATEMENT REGARDING FEDERALLY SPONSORED RESEARCH OR DEVELOPMENT

Not applicable.

TECHNOLOGICAL FIELD

The present disclosure relates to a device for tensioning an elongated hoisting member. More specifically the invention relates to a device for tensioning an elongated hoisting member, wherein said elongated hoisting member is adapted to run between first and second friction-generating members being rotatably supported on first and second support members, respectively. The present disclosure also relates to a system including such a device, as well as to a method for operating such a system.

BACKGROUND

In hoisting operations, insufficient tension in a wire rope stored on a winch drum may cause substantial damage to the wire rope. The insufficient tension may also constitute a potential safety issue. The challenge is particularly pronounced in deep water hoisting operations. For instance, when spooling in a long wire rope after having placed a load on the seabed, the weight of the wire itself is usually sufficient to ensure sufficient tension on the wire rope as it is being spooled onto the drum in a first part of a spooling operating. Towards the end of the spooling operation, e.g. the last 500 meters of wire rope or so, the weight of the wire rope itself is no longer sufficient to ensure the desired tension in the wire rope on the winch drum, implying that the upper layers of wire rope on the winch drum will be rather loose if the reduced tension is not compensated for. If a subsequent lift with a heavy load is to be performed, this may cause significant damage to the wire rope on the winch drum when a highly tensioned wire rope wears on the loosely spooled turns. This may cause significant and irreparable damage to the wire rope. Wire ropes may be very expensive, and they may also be time-consuming to replace.

One Solution to this problem has been to use one or more intermediate loads to tension up the wire rope for a heavier load in one or more intermediate lifting operations. Such intermediate lifting operations may be quite time-consuming and the intermediate loads typically take up space on deck of the vessel on which the crane is placed.

It is also known to used traction winches and capstans to tension up wire ropes when spooling onto a winch drum or other storage means. Capstans and traction winches are usually huge constructions that take up a lot a deck space if placed on a vessel. Further, due to their sizes, capstans and traction winches typically require designated vessels in order to be transported to various locations around the globe.

BRIEF SUMMARY OF THE DISCLOSURE

It is therefore an object of the present disclosure to provide an alternative device for tensioning an elongated hoisting member, such as a wire rope, as it is being spooled onto a storage device, such as a winch drum. It is a further object of the present disclosure to provide a device for controlling the tension in an elongated hoisting member, where the device is of a compact design and where the device preferably can be transported by means of standardized infrastructure.

The present disclosure has for its general object to remedy or to recue at least on of the drawbacks of the prior art, or at least provide a useful alternative to prior art.

The present disclosure has for its general object to remedy or to reduce at least one of the drawbacks of the prior art, or at least provide a useful alternative to prior art.

The object is achieved through features, which are specified in the description below and in the claims that follow.

In the following the term "elongated hoisting member" shall be taken to mean any elongated member used in hoisting of a load. One end of such an elongated hoisting member will typically be connected to a storage means such as a winch drum or a reel, while the other end will be connectable to a load, typically via a load suspension member. The elongated hoisting member may be any type of rope, cable, wire, chain, wire rope, etc. used in hoisting operations. Typically it will be a wire rope comprising wires made of steel and/or fibre.

In a first aspect, the present disclosure relates to a device for tensioning an elongated hoisting member, wherein said device comprises:

- a first friction-generating member rotatably supported around a first support member;
- a second friction-generating member rotatably supported around a second support member, said first and second friction-generating members being adapted to provide friction to the elongated hoisting member when said first and second friction-generating members are pressed against each other with a portion of the elongated hoisting member therebetween; and
- a brake configured to stop the rotation of said first and second friction-generating members around said first and second support members.

When spooling an elongated hoisting member between the first and second friction-generating members, the friction-generating members will start rotating around their respective support members in opposite directions due to the movement of the elongated hoisting member and the friction between the elongated hoisting member and the friction-generating members.

In one embodiment, the friction-generating members may be adapted to be actively driven, implying that the friction-generating members may contribute in spooling in and paying out elongated hoisting member. The friction-generating members may be driven by means of a hydraulic or electric motor. However, in a particular embodiment the first and second friction-generating members may be passively, rotatably supported around said first and second support members, respectively. This means that there may be no active drive connected to the device, and that the friction-generating members are merely rotating around their respective support members due to their frictional contact with the elongated hoisting member. The tensioning device will typically be deactivated when paying out wire rope, where the tension will be ensured by the weight of the load as well as the weight of the wire rope itself, which may be significant, particularly if using steel wires.

In one embodiment, said first and second friction-generating members may comprise a plurality contact pads being included in a first and a second friction belt, respectively.

The friction-generating members may thus take form of belts where contact pads constitute outer portions, i.e. the friction-generating parts, of said belts. The contact pads may be made at least partially from steel, and the surface of the contact pads that are to come into contact with the elongated hoisting member may be corrugated in order to obtain better friction. Steel pads may be specifically beneficial to use together with wire ropes comprising steel. Fibre ropes, which are typically more delicate compared steel wire ropes, may require a pad material that is equally more delicate.

In one embodiment the brake may comprise a disc brake. This may give particularly simple, robust, low-maintenance solution. One disc brake may be connected to one of friction-generating member each so as to brake/restrain/oppose the rotation of the friction generating member by generating a braking torque. The disc brake may thus generate the desired tension in the elongated hoisting member. The callipers of the disc brakes may be adjusted mechanically with a spring or the like or preferably hydraulically or pneumatically. In one embodiment the adjustment of the braking force via the callipers may be done manually via a small hand pump or the like enabling a step-less adjustment of the braking force. The hydraulic or pneumatic cylinders may be provided in or near the brake, integrated with the tensioning device according to the present disclosure, implying that no external supply of hydraulics or pneumatics may be needed. Instead, only water supply for cooling may be needed. Depending on the type of disc brake, the brake will typically be connected to the friction-generating members via a gear in order to be able to operate around its preferred rotational speed. The optimal gearing also depends on the spooling speed of the elongated hoisting member, but in some embodiments it may be in the order or 1:50. In one embodiment, the disc brake may be a water-cooled brake or clutch as provided by the company Wichita Clutch. Such a tensioning device then only requires an inlet for cooling water and an outlet for hot water.

A person skilled in the art will understand that the brake does not have to be a disc brake, but could also be provided as brake blocks or other braking means interacting directly or indirectly with the friction-generating member to create the desired braking force. In some embodiments, it may be an advantage if the braking force is manually adjustable as described above for the mechanical/hydraulic/pneumatic adjustment of callipers.

In one embodiment the first and second friction-generating members may be adapted to be pressed against each other by means of a plurality of hydraulic cylinders, each with a head part connected to one of said first and second support member and a base part connected to the other of said second support member. The way the support members, and thereby also the friction-generating members, are pressed against each other controls the friction between the friction-generating members and the elongated hoisting member. The hydraulic cylinders pressing the support members against each other may also be manually adjustable.

In one embodiment the tensioning device according to the present disclosure may be provided with a load distribution member for ensuring a uniform load distribution to a portion of said elongated hoisting member located between said first and second friction-generating members. The load distribution member may be provided between each friction generating member and its respective support member at least in a portion abutting the elongated hoisting member in use. In one embodiment, the load distribution member may include a plurality of pressing rollers, alternatively it may also include one or more resilient plates provided between the friction-generating members and their respective support members.

In another embodiment the present disclosure relates to a system for tensioning an elongated hoisting member, said system comprising:

- a device according to the first aspect of the disclosure set out above;
- an elongated hoisting member storage means; and
- an elongated hoisting member drive means for spooling in said elongated hoisting member, via said device onto said elongated hoisting member storage means.

In normal use, the elongated hoisting member storage means will typically be a winch drum, however it may any kind of storage means including a reel.

There is also described a crane comprising a device according to the first aspect of the present disclosure.

In one embodiment, the tensioning device according to the present disclosure may be integrated into a pedestal of said crane. This may be particularly useful if the winch itself is provided below deck of the vessel on which the crane is provided. This may provide a particularly compact, robust and low-maintenance tensioning device integrated into the inside of the crane itself. Typically the tensioning device according to the present disclosure may be connected to the inside of the crane pedestal by means of a plurality of tie bars or the like connectable to cross bars in the pedestal. This would also enable rather simple retrofitting of a tensioning device to an existing crane. It should also be noted that in an embodiment with the tensioning device permanently installed in a crane, for instance when designing a new crane with such a tensioning device integrated therein, it may be desirable to integrate the tensioning device with the control unit of the crane itself, making it possible to control the tensioning device from the crane housing. In such an integrated version the tensioning device may be connected to the electronic and hydraulic control systems of the crane, including to the crane's hydraulic power unit.

There is also described a mobile container unit comprising a tensioning device according to the first aspect of the present disclosure. Due to the compact design of such a tensioning device, in some embodiments, it is possible to fit it into a container of standardized shipping size. A container with such a tensioning device integrated therein may thus be placed on deck of a vessel near the crane in such a way the elongated hoisting member runs through the tensioning device in the container. The container may be formed with designated openings for the elongated hoisting member running in to and out. As described above, the adjustment of braking force and friction may be done manually with integrated hydraulics and/or pneumatics, implying that only cooling water for the brake need to be supplied to the container.

In a third aspect the present disclosure relates to a method for operating a system according to the description above, wherein the method comprises the steps of:

- spooling the elongated hoisting member onto said elongated hoisting member storage means; and
- engaging said device according to claim 1 in at least a part of said spooling operation in order to tension said elongated hoisting member on said storage means.

In deep water hoisting operations it may be necessary to engage the tensioning device during the last couple of hundred meters or so in order to ensure sufficient tension. The tensioning device as such may be integrated in the crane, such as in the crane pedestal or it may be provided on deck of the vessel, e.g. integrated in shipping container as described above.

In one embodiment, the braking force may be increased as the elongated hoisting member is being spooled in so that as to keep a substantially constant tension in the wire rope on the winch drum, irrespective of the remaining length of wire rope to be spooled in.

BRIEF DESCRIPTION OF THE DRAWINGS

In the following is described an example of an exemplary embodiment illustrated in the accompanying drawings, wherein.

DETAILED DESCRIPTION OF THE DISCLOSED EXEMPLARY EMBODIMENTS

Figure 1:
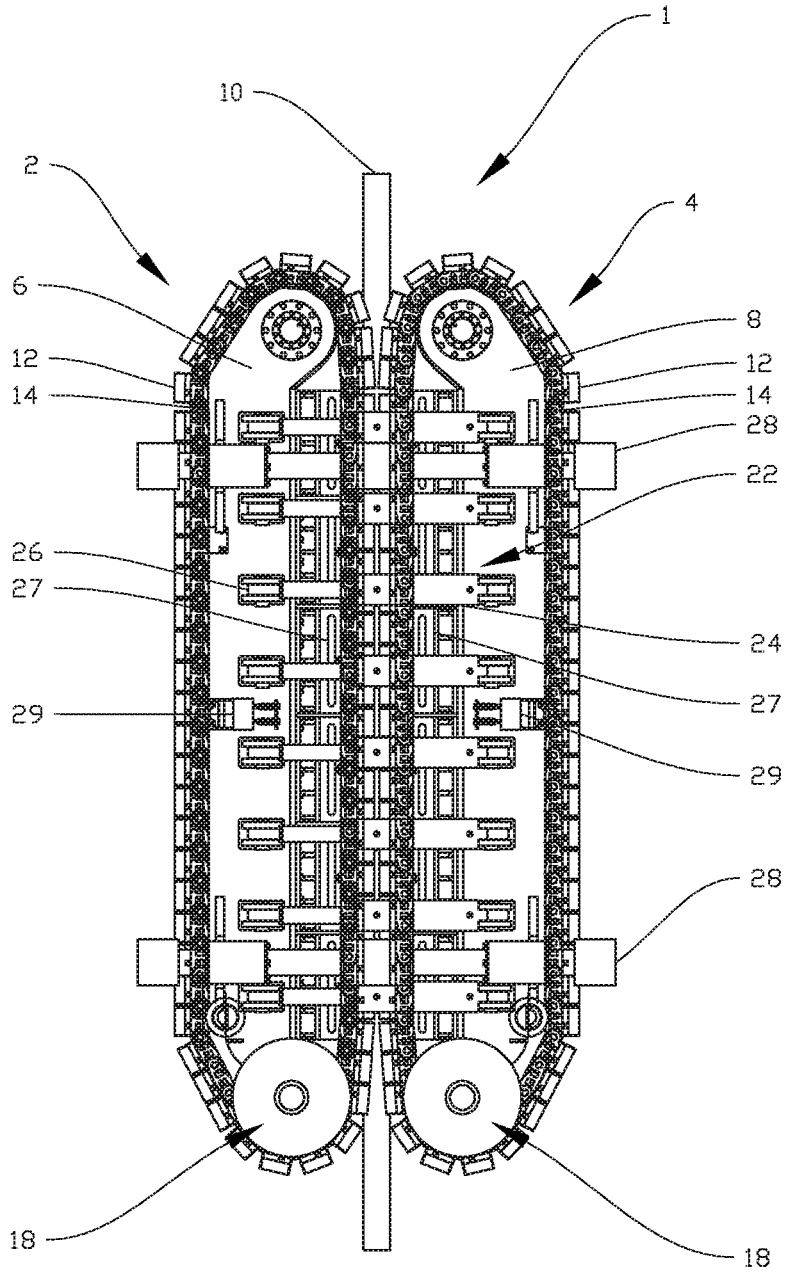
FIG. 1 shows, in a side view, a tensioning device according to the present disclosure.
Figure 2:
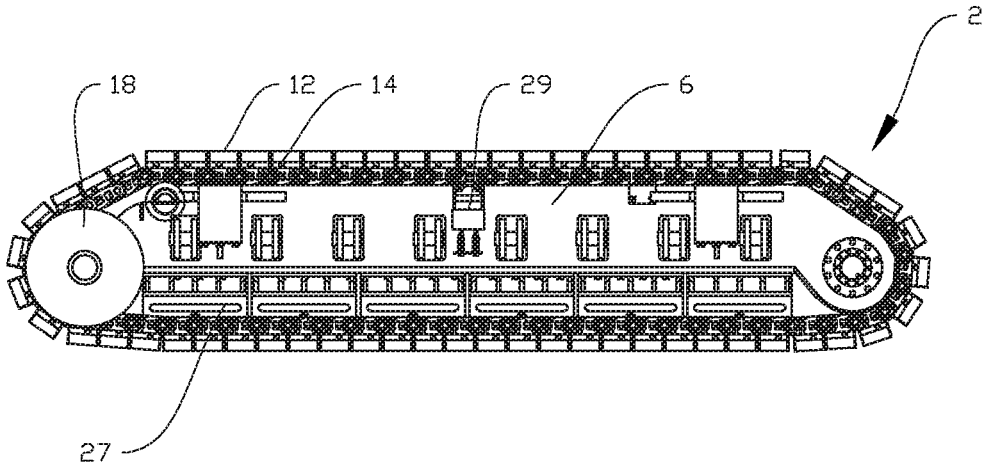
FIG. 2 shows, in a side view, a part of the tensioning device from FIG. 1.

In the following, the reference numeral 1 will indicate a tensioning device according to the present disclosure. Identical reference numerals indicate identical or similar features in the drawings. It should also be noted that the drawings are shown schematically and simplified and that the various features in the drawings are not necessarily drawn to scale.

Figure 3A:
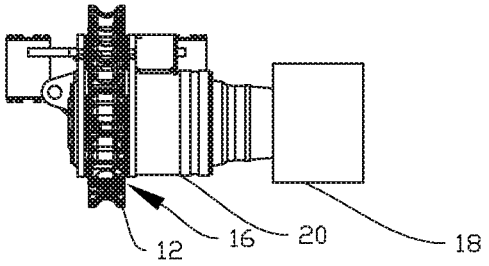
FIG. 3A-B shows, in an end view and in a top view, the part of the tensioning device of FIG. 2.
Figure 3B:
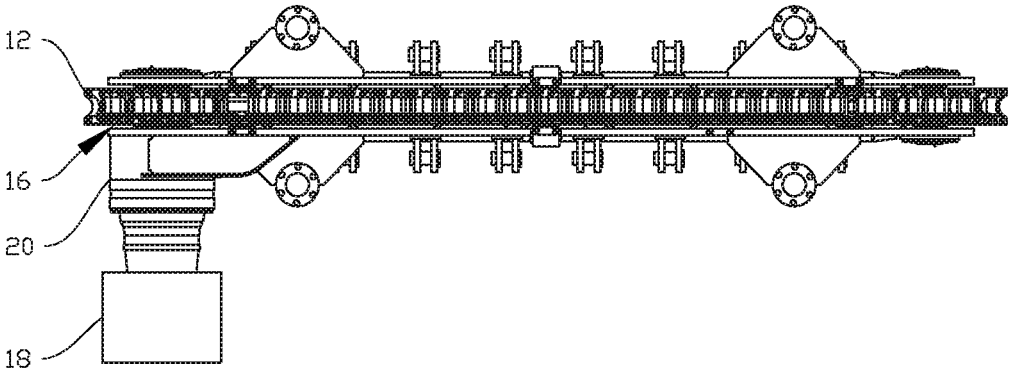

Attention is first drawn to FIGS. 1, 2 and 3A-B showing a tensioning device 1 according to the first aspect of the present disclosure in different views. The tensioning device 1 comprises a first tension-generating member 2, in the form of a first belt, rotatably supported around a first support member 6, and a second tension-generating member 4, in the form of a second belt, rotatably supported around a second support member 8. The first and second support members 6, 8 with respective belts 2, 4 give the tensioning 1 device the look of two caterpillar tracks facing each other with an elongated hoisting member 10, here shown as only a short part of a wire rope, therebetween. Each of the belts 2, 4 comprise a plurality of contact pads 12 constituting outer, friction-creating parts of each belt 2, 4. In use, some of the contacts pads 12 will be in contact with the wire rope 10 and create friction sufficient for the wire rope to rotate the belts 2, 4 around their respective support members 6, 8. An inner portion of each of the belts 2, 4 comprises a chain 14 to which the contacts pads 12 are connected. The chain 14 engages a gear wheel 16, only indicated by its position in FIGS. 3A-B, that rotates a not shown shaft connected to a brake 18 via a gear box 20 as best seen in FIGS. 3A-B. The friction between the belts 2, 4 and the wire rope 10 is ensured by a plurality of hydraulic cylinders 22 with a head part 24 connected to the first support member 6 and a base part 26 connected to the second support member 8, the hydraulic cylinders 22 pressing the two support members 6, 8 against each other. The cylinders 22 may thereby be used to adjust the pressure between the two belts 2, 4 and thus also the friction between the belts 2, 4 and the wire rope 10. In the shown embodiment, the cylinders 22 are manually adjustable and do not require connection to any external hydraulic supply and power unit. Further, in the shown embodiment the brake 18 comprises a disc brake with a braking force controllable by means of not shown hydraulically actuated callipers. The braking energy primarily ends up as heat which is cooled away by means of a not shown water supply.

Figure 4:
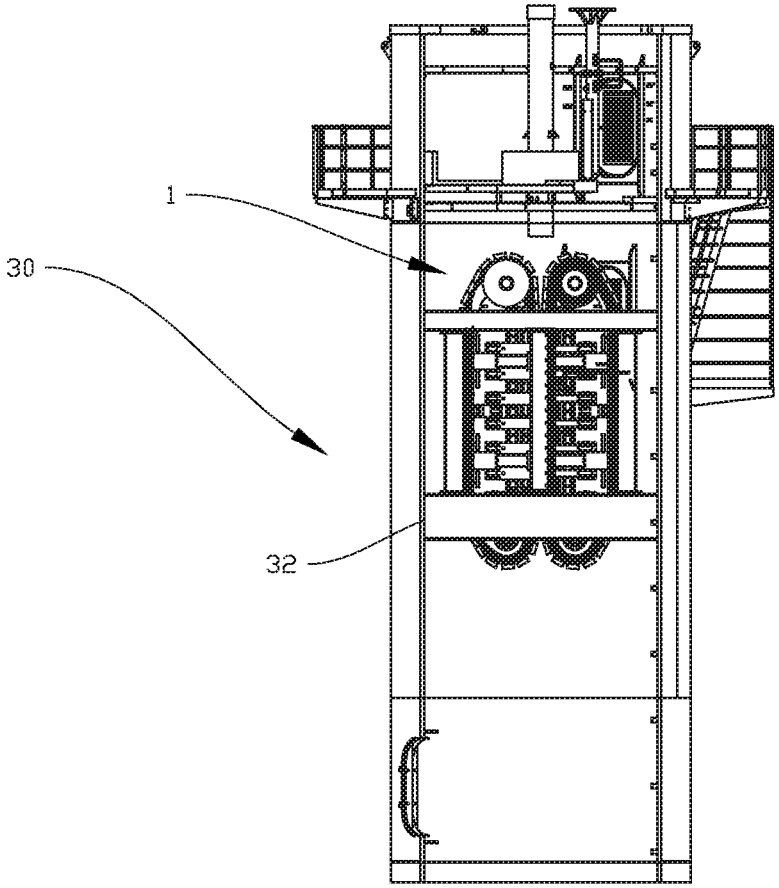
FIG. 4 shows, in a side view and in reduced scale, a tensioning according to the present disclosure as integrated into a lifting crane.

Further, in the shown embodiment the belts 2, 4 are passively, rotatably supported around their respective support members 6, 8, implying that there is no active drive on the brake 18. The wire rope 10 is spooled in by means a not shown winch that is located downstream of the tensioning device 1, the tensioning device 1 being adapted to create the desired tension in the wire rope 10 as it is being spooled onto the winch drum. In order to ensure a uniform load distribution, the tensioning device 1 is provided with load distribution members, here in the form of pressure rollers not shown in detail, between the each of the support members 6, 8 and their respective belts 2, 4 in a portion of the support members 6, 8 facing each other. The pressure rollers are provided in cartridges 27, where the chain part 14 of the belts 2, 4 glide over the pressing rollers in use. The tensioning device 1 is also shown provided with tie bars 28 for the integration of the tensioning device 1 into a crane 30, as shown in FIG. 4, or for the connection inside a shipping container as described above. Each support member 6, 8 is provided with a spanning member 29 abutting the chain 14 in use, and adjustable to regulate the tension/span in the belts 2, 4 themselves. In an alternative, not shown, embodiment the span in the belts 2, 4 could adjustable by supporting said gear wheels 16 on eccentric shafts, so as to adjust the span/tension in each of the belts 2, 4 by simply turning the respective eccentric shafts.

In FIG. 4 a tensioning device according to the present disclosure is shown integrated into a pedestal 30 of a crane not shown in detail. The tie bars 28 of the tensioning device 1, which are not visible in the figure, are clamped to cross-bars 32 inside the crane pedestal 30. In the shown embodiment, the tensioning device 1 is fixedly, non-rotatably supported inside the pedestal 30. A not shown winch is provided under deck, i.e. downstream of the tensioning device 1, of a not shown vessel on which the crane pedestal 30 is placed. In alternative embodiment, a tensioning device 1 according to the present disclosure may be connected inside the pedestal 28 by bolting and/or welding or by a variety of different ways as will be understandable to a person skilled in the art. In the shown embodiment, the brake 18 are provided at an upper portion of the tensioning device 1, i.e. opposite of what was shown in FIG. 1.

The tensioning device 1 according to the present disclosure will typically not be in use when paying out wire rope 10. Neither will the tensioning device 1 be in use during heave compensation. When spooling in a wire rope 10 after a load has been placed on a seabed, the tensioning device 1 may be activated during the spooling of the last few hundred meters or more, e.g. during the last 500 meters or so. In the shown embodiment, the braking force of the brake 18 is step-less adjustable, and preferably the braking force is increased as the wire rope 10 is being spooled in, in order to keep a substantially constant tension in the wire rope 10 stored on the not shown winch drum.

It should be noted that the above-mentioned embodiments illustrate rather than limit the present disclosure, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. Device for tensioning an elongated hoisting member, comprising:

a first friction-generating member rotatably supported around a first support member;

a second friction-generating member rotatably supported around a second support member, said first and second friction-generating members being adapted to provide friction to the elongated hoisting member when said first and second friction-generating members are pressed against each other with a portion of the elongated hoisting member there-between, and wherein said first and second friction-generating members are passively, rotatably supported around said first and second support members respectively;

a motorless shaft assembly comprising a shaft coupled to the first friction-generating member and a brake coupled to the shaft, wherein the brake is configured to stop the rotation of said first friction-generating member around said first support member.

2. Device according to claim 1, wherein said first and second friction-generating members comprise a plurality contact pads being included in a first and a second friction belt, respectively.

3. Device according to claim 1, wherein said brake is a disc brake.

4. Device according to claim 3, wherein the brake is configured such that the braking force may be hydraulically or pneumatically adjusted.

5. Device according to claim 1, wherein the brake is configured such that the braking force exerted by said brake on said first and second friction-generating members may be manually adjusted.

6. Device according to claim 1, wherein said first and second friction-generating members are configured such that they may be pressed against each other by means of a plurality of hydraulic cylinders, each with a head part connected to one of said first support and second support member and a base part connected to the other of said first and second support members.

7. Device according to claim 1, wherein the device further comprises a load distribution member configured to provide a uniform load distribution to a portion of said elongated hoisting member located between said first and second friction-generating members.

8. Device according to claim 7, wherein said load distribution member includes a plurality of rollers being provided under at least a portion of said first and second friction-generating members.

9. Device according to claim 1, further comprising a connection for water supply for cooling of said brake.

10. Device according to claim 1, wherein a first end of the motorless shaft assembly comprises the brake and a second end of the motorless shaft assembly, opposite the first end, comprises a gear wheel coupled to the shaft.

11. A crane for lifting a load using an elongated hoisting member, comprising:

a pedestal;

a winch drum configured to store the elongated hoisting member;

a drive configured to spool to the elongated hoisting member onto the winch drum; and a tensioning device coupled to the pedestal and comprising:

a first friction-generating member rotatably supported around a first support member a second friction-generating member rotatably supported around a second support member, said first and second friction-generating members being adapted to provide friction to the elongated hoisting member when said first and second friction-generating members are pressed against each other with a portion of the elongated hoisting member there-between, and wherein said first and second friction-generating members are passively, rotatably supported around said first and second support members respectively; and a brake configured to stop the rotation of said first friction-generating member around said first support member.

12. The crane of claim 11, wherein the tensioning device is positioned inside the pedestal.

13. The crane of claim 11, wherein the tensioning device comprises a motorless shaft assembly comprising a shaft coupled to the first friction-generating member and to the brake.

14. The crane of claim 11, wherein the first and second friction-generating members of the tensioning device comprise a plurality contact pads being included in a first and a second friction belt, respectively.

15. The crane of claim 11, wherein the brake of the tensioning device is configured such that the braking force may be hydraulically or pneumatically adjusted.

16. The crane of claim 11, wherein the tensioning device further comprises a load distribution member configured to provide a uniform load distribution to a portion of said elongated hoisting member located between said first and second friction-generating members.

17. A method for lifting a load with an elongated hoisting member, comprising:

(a) activating a winch drum of a crane to spool the elongated hoisting member onto the winch drum;

(b) pressing a first friction-generating member of a tensioning device of the crane against a second friction-generating member of the tensioning device with a portion of the elongated hoisting member there-between, wherein said first and second friction-generating members are passively, rotatably supported around a first support member and a second support member respectively, of the tensioning device; and (c) applying a braking force to the elongated hoisting member from the tensioning device as the elongated hoisting member is spooled onto the winch drum, whereby the tensioning device tensions the elongated hoisting member as the hoisting member is spooled onto the winch drum.

18. The method of claim 17, wherein (c) comprises increasing the braking force applied to the elongated hoisting member from the tension device to maintain a substantially constant tension in the elongated hoisting device as the elongated hoisting device is spooled onto the winch drum.

19. The method of claim 17, wherein (c) comprises:

(c1) frictionally engaging the elongated hoisting member with a plurality of contact pads of the tensioning device; and (c2) applying a braking force to a shaft of a motorless shaft assembly of the tensioning device from a brake of the motorless shaft assembly.

* * * * *